US008267440B2

(12) United States Patent
Shen

(10) Patent No.: US 8,267,440 B2
(45) Date of Patent: Sep. 18, 2012

(54) CONNECTING DEVICE FOR CONCEALED-TYPE TOP OR BOTTOM LATCH FOR PANIC EXIT DOOR LOCK

(75) Inventor: Chun-Meng Shen, Sinying (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 376 days.

(21) Appl. No.: 12/688,961

(22) Filed: Jan. 18, 2010

(65) Prior Publication Data

US 2010/0117376 A1 May 13, 2010

Related U.S. Application Data

(63) Continuation-in-part of application No. 12/211,879, filed on Sep. 17, 2008, now abandoned.

(51) Int. Cl.
*E05B 65/10* (2006.01)

(52) U.S. Cl. ..... 292/92; 292/DIG. 65; 292/21

(58) Field of Classification Search ..... 292/92, 292/DIG. 65, 21
See application file for complete search history.

(56) References Cited

U.S. PATENT DOCUMENTS

| | | | | |
|---|---|---|---|---|
| 4,741,563 | A | 5/1988 | Cohrs | 292/21 |
| 4,906,034 | A * | 3/1990 | Verslycken | 292/92 |
| 4,961,330 | A | 10/1990 | Evans | 292/21 |
| 4,974,890 | A | 12/1990 | Cohrs | 292/363.3 |
| 5,520,427 | A | 5/1996 | Mader | 292/336.3 |
| 5,564,760 | A | 10/1996 | Mader | 292/182 |
| 5,566,994 | A | 10/1996 | Mader | 292/336.3 |
| 5,570,916 | A | 11/1996 | Mader | 292/336.3 |
| 5,816,017 | A * | 10/1998 | Hunt et al. | 52/784.11 |
| 6,532,777 | B2 * | 3/2003 | Haeck et al. | 70/92 |
| 7,364,212 | B1 | 4/2008 | Fan | 292/336.3 |
| 7,748,757 | B2 * | 7/2010 | Shen | 292/92 |

* cited by examiner

*Primary Examiner* — Carlos Lugo
*Assistant Examiner* — Mark Williams
(74) *Attorney, Agent, or Firm* — Alan Kamrath; Kamrath IP Lawfirm, PA

(57) ABSTRACT

A lock for a door includes a latch (128) to which an end of a connecting member (46) is operably coupled. A draw rod (48) is securely mounted to the connecting member (46) to move therewith. A base (32) is fixed to the door, and a slide (42) is slideably mounted to the base (32) in the vertical direction. An adjusting block (44) is fixed to the draw rod (48) to move therewith. An adjusting screw (446) is rotatably extended through the slide (42) and threadedly engaged with the adjusting block (44) so that movement of the slide (42) in the vertical direction causes movement of the adjusting block (44) and the connecting member (46) in the vertical direction and of the latch (128) between locking and unlocking positions. Rotation of the adjusting screw (446) causes movement of the adjusting block (44) and the connecting device (40) in the vertical direction to adjust the locking position of the latch (128) relative to the door (10).

7 Claims, 12 Drawing Sheets

CONNECTING DEVICE FOR CONCEALED-TYPE TOP OR BOTTOM LATCH FOR PANIC EXIT DOOR LOCK

CROSS REFERENCE TO RELATED APPLICATION

This is a continuation-in-part application of U.S. patent application Ser. No. 12/211,879 filed Sep. 17, 2008, now abandoned.

BACKGROUND OF THE INVENTION

The present invention relates to a connecting device for a panic exit door lock and, more particularly, to a connecting device for a concealed-type top or bottom latch for a panic exit door lock that allows easy mounting of the connecting device and that allows adjustment of projection of the top or bottom latch beyond a top face or a bottom face of the panic exit door to allow easy mounting of the lock.

Locks for panic exit doors include horizontal type latches and vertical type latches. Vertical type latches include a top latch and a bottom latch, and the top and bottom latches include a concealed type and a surfaced type according to the way they are mounted. Surfaced type latches are easy to install but can not provide an aesthetically pleasing appearance. Concealed type latches provide an aesthetically pleasing appearance at the cost of difficulties in installation.

FIG. 12 shows a conventional panic exit door 70 including a side opening 702 in an inner side thereof. Door 70 further includes an end opening 704 in each of a top edge and a bottom edge thereof. A panic device or lock 80 is mounted to door 70 and includes an operative device 84, a follower device 82, and concealed type top and bottom latch devices 76 both mounted in an interior space 706 in door 70 and each having a latch 762. A hole or stop is formed on each of a top edge and a bottom edge of a door frame for coupling with latch 762 when door 70 is closed. Each latch device 76 further includes a screw rod 764 having a first end coupled to latch 762 and a second end coupled to an end of a coupling rod 74. The other end of each coupling rod 74 is coupled to a vertical section 724 of a connecting rod 72. Each connecting rod 72 includes a horizontal section 722 extending out of door 70 via side opening 702 and coupled with follower device 82. Operation of operative device 84 causes movement of follower device 82, connecting rods 72, and coupling rods 74 to move latches 762 for locking or unlocking purposes. In practice, connecting rods 72 and coupling rods 74 are inserted via side opening 702 into interior space 706 of door 70 in an inclined angle for installation purposes. Coupling rods 74 are then threadedly coupled to screw rods 764. Such installation is difficult for a single installer. Furthermore, the projections of latches 762 after installation may be more or less and, thus, adversely affect operation of latches 762. In an approach to solve this problem, coupling rod 74 is rotated to adjust a coupling length between screw rod 764 and coupling rod 74, which, in turn, changes the projection of latch 762. However, such adjustment must be accomplished before coupling of connecting rod 72 with follower device 82. Specifically, if the improper projections of latches 762 are found after installation, adjustment can only be carried out after removal of a housing enclosing follower device 82 and after disengaging an end of connecting rod 72 from follower device 82.

Thus, a need exists for a connecting device for a concealed-type top or bottom latch for a panic exit door that allows easy installation of the connecting device and that allows adjustment of projection of the top or bottom latch beyond a top face or a bottom face of the panic exit door to allow easy mounting of the lock.

BRIEF SUMMARY OF THE INVENTION

The present invention solves this need and other problems in the field of locks for panic exit doors by providing, in a preferred form, a lock including a latch movable between an extended, locking position not allowing opening of a door and a retracted, unlocking position allowing opening of the door. A connecting member includes first and second ends spaced in a vertical direction. The second end of the connecting member is adapted to be operably coupled to the latch. A draw rod includes first and second sidewalls spaced in a width direction perpendicular to the vertical direction. The draw rod further includes an interconnecting wall interconnected between the first and second sidewalls and securely mounted to the first end of the connecting member. A base is adapted to be fixed to a side of the door, and a slide is slideably mounted to the base in the vertical direction. The slide is operably coupled to an operative member. An adjusting block is mounted to the slide. The adjusting block and the slide are jointly moveable in the vertical direction. The adjusting block includes first and second sides spaced in the width direction. The first and second sidewalls of the draw rod are respectively fixed to the first and second sides of the adjusting block to move therewith. The adjusting block is moveable relative to the slide in the vertical direction to adjust the extended, locking position of the latch relative to the door. Manual operation of the operative member causes movement of the slide, the adjusting block, and the connecting member in the vertical direction to move the latch between the extended, locking position and the retracted, unlocking position.

In the most preferred form, the lock further includes an adjusting screw rotatably extending through a pivotal section of the slide and threadedly coupled to the adjusting block to engage the adjusting block with the slide. Rotation of the adjusting screw causes movement of the adjusting block and the connecting member in the vertical direction to adjust the extended, locking position of the latch relative to the door. The first end of the connecting member includes first and second faces spaced in a thickness direction perpendicular to the vertical and width directions. The first end of the connecting member has a first width in the width direction. The interconnecting wall of the draw rod includes first and second faces spaced in the thickness direction. The interconnecting wall of the draw rod further includes a recessed portion having a second width in the width direction approximately the same as the first width. The first end of the connecting member is received in the recessed portion with the first face of the first end of the connecting member abutting the second face of the interconnecting wall. The adjusting block is sandwiched between the first and second sidewalls of the draw rod in the width direction.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
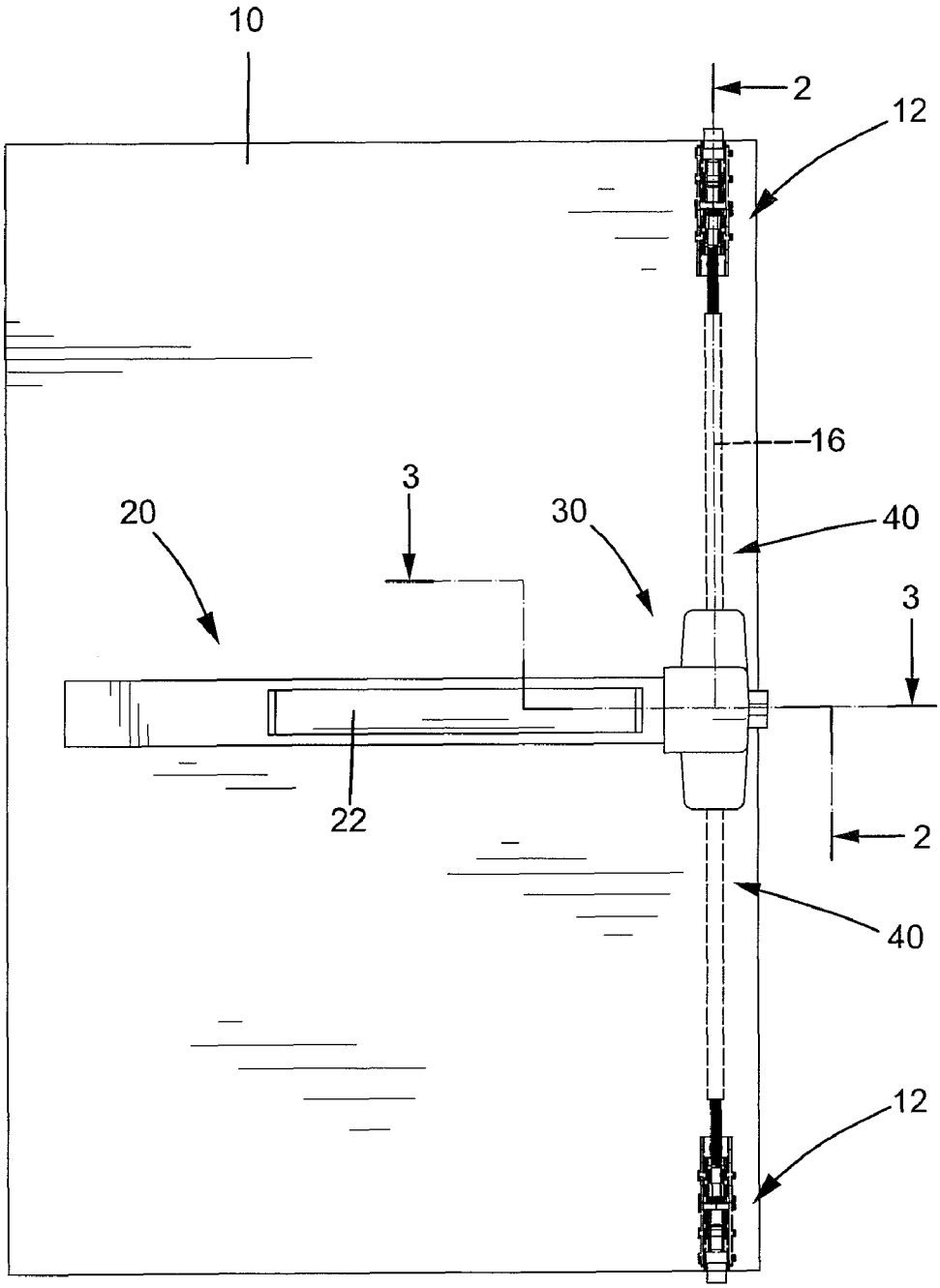
FIG. 1 shows a diagrammatic side view of a panic exit door and a lock mounted to the panic exit door and utilizing connecting devices according to the preferred teachings of the present invention.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "upper", "lower", "front", "rear", "inner", "outer", "end", "portion", "section", "longitudinal", "horizontal", "vertical", "spacing", "length", "width", "thickness", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 8:
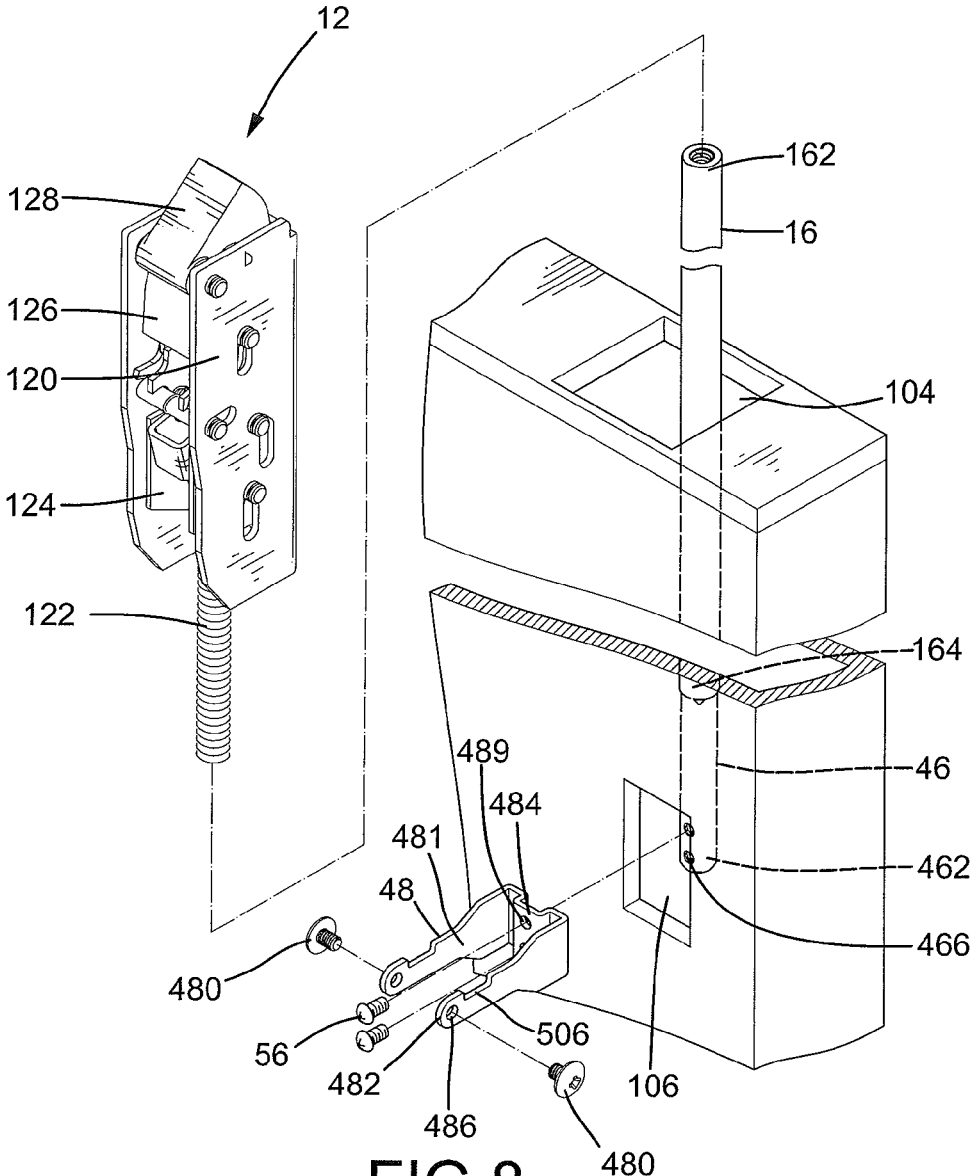
FIG. 8 shows a partial, exploded, perspective view of the door, a top latch, and the connecting device of FIG. 1, illustrating mounting of a connecting member of the connecting device and the top latch via an end opening in a top face of the door.

A connecting device according to the preferred teachings of the present invention is shown in the drawings and generally designated 40. Connecting device 40 is generally utilized with a panic device or lock mounted to a panic exit door 10. According to the preferred form shown, the lock mounted to door 10 includes an operative device 20, a follower device 30 operably connected to operative device 20, top and bottom latch devices 12 operably connected to follower device 30, a sliding device 50, and two connecting devices 40 according to the preferred teachings of the present invention. Operative device 20 and follower device 30 are mounted to an inner side of door 10. Door 10 is hollow and includes an interior space 102. Door 10 further includes an end opening 104 in each of a top edge and a bottom edge thereof. Door 10 further includes two side openings 106 in the inner side (see FIG. 9). End openings 104 and side openings 106 are in communication with interior space 102. According to the preferred form shown, each of top and bottom latch devices 12 are mounted into interior space 102 via one of end openings 104. Each of top and bottom latch devices 12 includes a body 120, a latch 128 pivotably connected to body 120, a follower 124 slideably mounted in body 120 in a vertical direction, and a linking member 126 having a first end coupled to follower 124 and a second end coupled to latch 128 (FIG. 8). Follower 124 is coupled to a screw rod 122 that can be moved to move latch 128 between an extended, locking position outside of door 10 and a retracted, unlocking position inside of door 10.

According to the preferred form shown, follower device 30 includes a base 32 fixed to the inner side of door 10 by fasteners such as screws, bolts, or the like. Specifically, base 32 includes a first side 322 and a second side 324 abutting the inner side of door 10. Base 32 further include upper and lower slots 323 spaced in the vertical direction. Parallel, spaced first and second tabs 326 are formed on two sides of upper slot 323 and include aligned vertical tracks 328 extending in the vertical direction and forming an upper guiding mechanism 320. Parallel, spaced third and fourth tabs 326 are formed on two sides of lower slot 323 and include aligned vertical tracks 328 extending in the vertical direction and forming a lower guiding mechanism 320. A sliding slot 325 extends from an edge of each of upper and lower slots 323 in the vertical direction.

According to the preferred form shown, follower device 30 further includes a bracket 36 in the most preferred form shown as a substantially U-shaped structure having parallel, spaced first and second sidewalls 362 spaced in the vertical direction. Bracket 36 further includes an interconnecting wall 363 interconnected between first and second sidewalls 362. Each of first and second sidewalls 362 has a plurality of engaging portions 366. Fasteners 368 are extended through engaging portions 366 to fix bracket 36 to base 32. First and second sidewalls 362 further include aligned limiting slots 364.

According to the preferred form shown, a linking rod 38 is mounted between and spaced from first and second sidewalls 362 of bracket 36 in the vertical direction. Linking rod 38 includes front and rear ends 382 and 384 spaced in a longitudinal axis thereof perpendicular to the vertical direction. Front end 382 of linking rod 38 includes a slot 383. A limiting pin 361 is slideably extended through limiting slots 364 of bracket 36 and slot 383 of linking rod 38. An upper limiting block 380 is mounted in a spacing between an outer face of front end 382 of linking rod 38 and first sidewall 362 of bracket 36, and a lower limiting block 380 is mounted in a spacing between an inner face of front end 382 of linking rod 38 and second sidewall 362 of bracket 36. Each of upper and lower limiting blocks 380 have a length in the vertical direction equal to the spacing between linking rod 38 and sidewall 362 to assist in stable movement of linking rod 38 along the longitudinal axis between first and second sidewalls 362 of bracket 36. Upper and lower wings 386 are formed on linking rod 38 adjacent front end 382. Each of upper and lower wings 386 has a sliding groove 388 extending in the vertical direction. Linking rod 38 further includes a slot 385 adjacent to rear end 384.

According to the preferred form shown, follower device 30 further includes a plate 60 fixed to linking rod 38 and two substantially V-shaped links 66. Plate 60 includes upper and lower grooves 602 aligned with sliding grooves 388 of upper and lower wings 386. Each link 66 has a first end 662, a second end 666 pivotably connected to one of engaging portions 366 of bracket 36, and an intermediate portion 664. First end 662 of each link 66 includes first and second pegs 663 on two faces thereof. First peg 663 of each link 66 is slideably received in sliding groove 388 of one of upper and lower wings 386. Second peg 663 of each link 66 is slideably received in one of upper and lower grooves 602 of plate 60.

According to the preferred form shown, operative device 20 includes a housing 26 fixed to the inner side of door 10 and an operative member 22 in the most preferred form shown as a press bar pivotably coupled to housing 26. A rocker 24 is mounted in housing 26 and includes a first corner 242 pivotably connected to operative member 22, a second corner 244 pivotably coupled with slot 385 of linking rod 38, and a third corner 246 pivotably connected to housing 26. When operative member 22 is operated (e.g., pressed), rocker 24 pivots to move linking rod 38 in an unlatching direction. Operative device 20 for actuating linking rod 38 can be of any desired form as conventional including but not limited to of a commercially available type.

According to the preferred form shown, sliding device 50 is mounted to guiding mechanisms 320 on base 32. Sliding device 50 includes an upper slide 42, slideably mounted between first and second tabs 326 in the vertical direction, and a lower slide 42, slideably mounted between third and fourth tabs 326 in the vertical direction. Each of upper and lower slides 42 includes a base portion 422 extending in the vertical direction, a support 426 extending perpendicularly from a side of base portion 422, a pivotal section 424 extending perpendicularly from the side of base portion 422 and spaced from support 426 in the vertical direction, and a groove 428 formed in base portion 422 and extending in a width direction parallel to the longitudinal axis and spaced from support 426 in the vertical direction. Groove 428 has a spacing to pivotal section 424 larger than support 426. Pivotal section 424 includes a vertical hole 423 and a positioning hole 425 in the most preferred form shown as a screw hole extending perpendicularly to and in communication with vertical hole 423. Base portion 422 further includes an axle hole 429 parallel to and spaced from positioning hole 425 in a direction perpendicular to the vertical direction. Support 426 includes a receiving hole 427 aligned with vertical hole 423. An upper axle 420 is extended through axle hole 429 of upper slide 42 and slideably extended through vertical tracks 328 of first and second tabs 326, allowing upper slide 42 to slide between first and second tabs 326 in the vertical direction. A lower axle 420 is extended through axle hole 429 of lower slide 42 and slideably extended through vertical tracks 328 of third and fourth tabs 326, allowing lower slide 42 to slide between third and fourth tabs 326 in the vertical direction, with grooves 428 adjacent to each other. A retainer 432 in the most preferred form shown as a C-clip is mounted in an annular groove **420*a* in a distal end of each of upper and lower axles 420, preventing upper and lower axles 420 from disengaging from upper and lower slides 42**.

Figure 9:
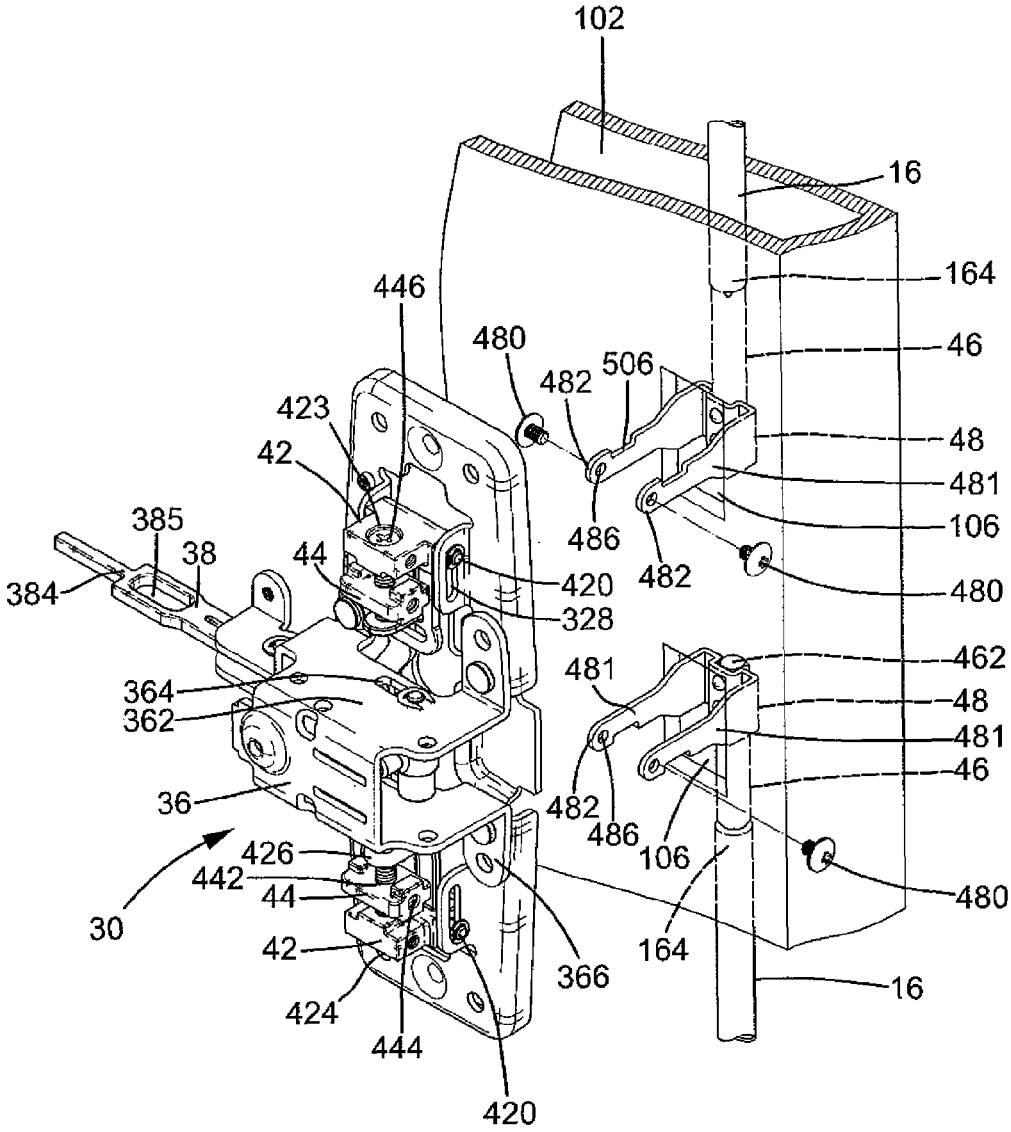
FIG. 9 shows a partial, exploded, perspective view of the door and the lock of FIG. 1 with draw members of the connecting devices in a position ready for coupling with adjusting blocks of a sliding device of the lock.
Figure 10:
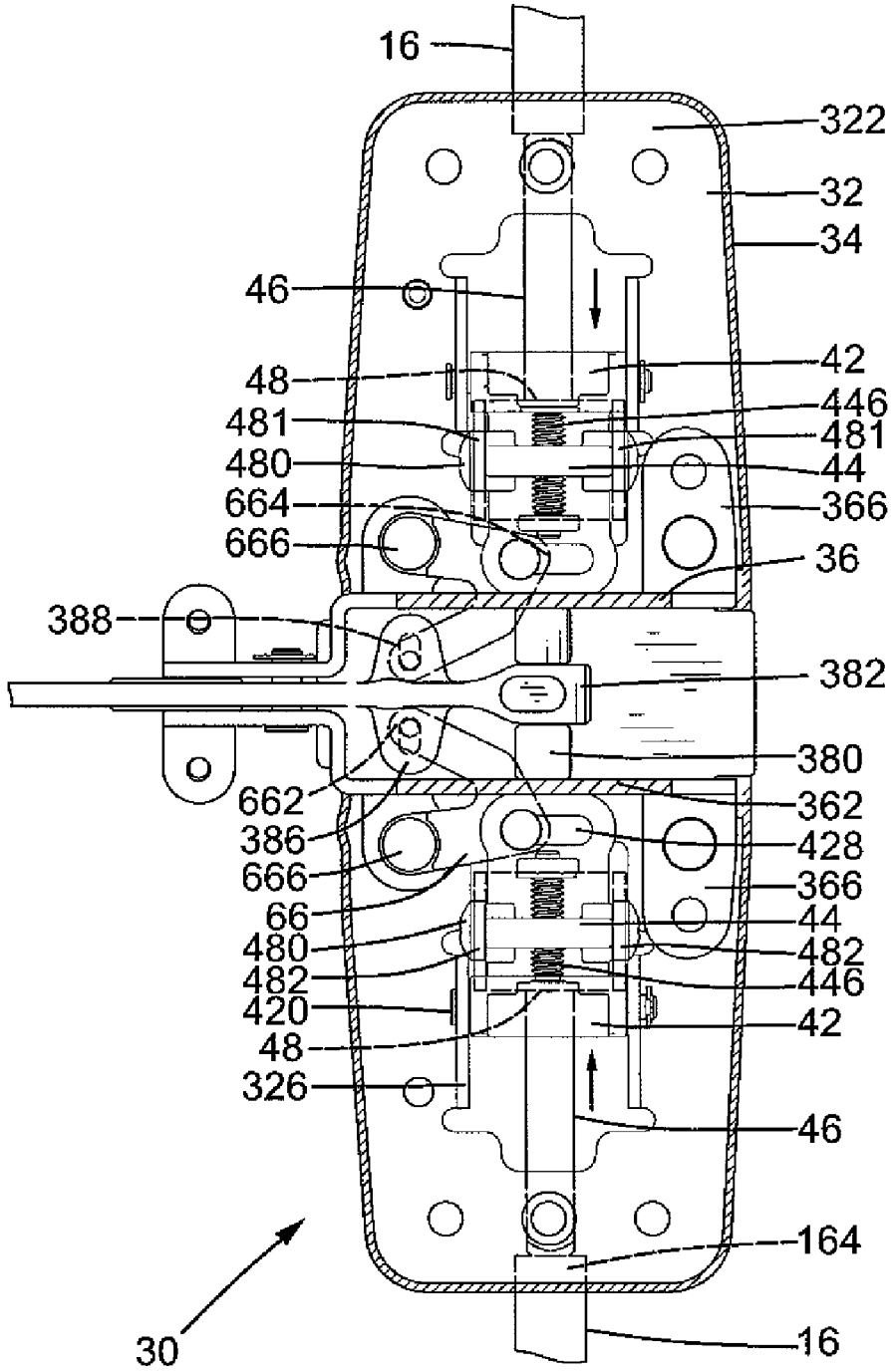
FIG. 10 shows a partial, cross-sectional view of the lock of FIG. 1 with a linking rod moved to pivot two links for unlatching purposes.

According to the preferred form shown, an adjusting block 44 is mounted on each of upper and lower slides 42. Each adjusting block 44 includes a screw hole 442 extending in the vertical direction and aligned with vertical hole 423 of pivotal section 424 of slide 42 (FIG. 9). Each adjusting block 44 further includes first and second sides 443 spaced in the width direction. A positioning hole 444 in the most preferred form shown as a screw hole is formed in each of first and second sides 443 and extends in the width direction.

According to the preferred form shown, sliding device 50 further includes two adjusting screws 446 each including a head 455 and a shank 450 extending from side of head 455 and having a diameter smaller than that of head 455. Shank 450 has a threaded section 451 and an annular groove 452 formed between head 455 and threaded section 451. Shank 450 further includes a pivotal portion 453 in the most preferred form shown formed at the distal end distant to head 455. Shank 450 of each adjusting screw 446 extends through vertical hole 423 of pivotal section 424 of one of upper and lower slides 42 and through screw hole 442 of one of adjusting blocks 44. Each adjusting screw 446 is retained in place by a retainer 448 in the most preferred form shown as a C-clip engaged in annular groove 452, allowing free rotation of adjusting screw 446 and preventing adjusting screw 446 from disengaging from pivotal section 424. Note that a face of each adjusting screw 446 presses against the side of one of upper and lower slides 42. Thus, when adjusting screws 446 are rotated, adjusting blocks 44 move along adjusting screws 446 in the vertical direction rather than rotate together with adjusting screws 446. Note that a screw (not shown) can be extended into positioning hole 425 of one of upper and lower slides 42 to press against head 455 of one of adjusting screws 446 and to prevent rotation of adjusting screw 446 after adjusting screw 446 is rotated to a desired position. Further, pivotal portion 453 of each adjusting screw 446 is rotatably received in receiving hole 427 of support 426 of one of upper and lower slides 42, assuring stable rotation of adjusting screw 446.

Further, two pins 668 respectively extend through intermediate portions 664 of links 66 and slideably extend through grooves 428 of upper and lower slides 42. Thus, intermediate portion 664 of each link 66 is pivotable relative to one of upper and lower slides 42 and slideable along groove 428 of one of upper and lower slides 42. When linking rod 38 is moved along the longitudinal axis, links 66 are rotated to move upper and lower slides 42 toward or away from each other in the vertical direction, moving top and bottom latch devices 12.

According to the preferred form shown, two connecting devices 40 according to the preferred teachings of the present invention are provided for top and bottom latch devices 12. According to the most preferred form shown, connecting devices 40 are identical so that description of one of them is sufficient. Connecting device 40 includes a connecting member 46 having first and second ends 462 and 464 spaced in a vertical direction. According to the most preferred form shown, second end 464 of connecting member 46 is a threaded section. A connecting rod 16 includes a first end 162 threadedly connected to screw rod 122 of latch device 12 and a second end 164 threadedly coupled to second end 464 of connecting member 46. Thus, latch 128 is moved when connecting member 46 is moved. First end 462 of connecting member 46 has a first width in the width direction. First end 462 of connecting member 46 further includes first and second faces 461 and 465 spaced in a thickness direction perpendicular to the vertical and width directions. Two coupling holes 466 extend from first face 461 through second face 465 of first end 462 of connecting member 46.

According to the preferred form shown, connecting device 40 further includes a draw rod 48 having substantially U-shaped cross sections. Draw rod 48 includes first and second sidewalls 481 spaced in the width direction and an interconnecting wall 484 interconnected between first and second sidewalls 481. Interconnecting wall 484 of draw rod 48 includes first and second faces 485 and 487 spaced in the thickness direction. A recessed portion 483 is formed in interconnecting wall 484 and has a second width in the width direction approximately the same as the first width, such that first end 462 of connecting member 46 is received in recessed portion 483 with first face 461 of first end 462 of connecting member 46 abutting second face 487 of interconnecting wall 484. Recessed portion 483 includes two through-hole 489 extending from first face 485 through second face 487 of interconnecting wall 484. Interconnecting wall 484 of draw rod 48 is securely mounted to first end 462 of connecting member 46 by extending fasteners 56 through through-holes 489 of interconnecting wall 484 into coupling holes 466 of connecting member 46. Each of first and second sidewalls 481 of draw rod 48 includes a distal end 482 distant to interconnecting wall 484. Aligned through-holes 486 are formed in distal ends 482 of first and second sidewalls 481. Distal ends 482 of first and second sidewalls 481 of draw rod 48 are respectively coupled to first and second sides 443 of adjusting block 44. According to the preferred form shown, adjusting block 44 has a length in the width direction which is approximately the same as a spacing between first and second sidewalls 481 of draw rod 48 such that adjusting block 44 is sandwiched between first and second sidewalls 481 of draw rod 48. Further, each of first and second sidewalls 481 of draw rod 48 includes outer and inner faces 490 and 488 spaced in the vertical direction. A notch 506 is formed in outer face 490 of each of first and second sidewalls 481 of draw rod 48 for avoiding interference during adjustment operation.

In installation, each connecting member 46 can be inserted through end opening 104 of door 10 into interior space 102 of door 10. When first end 462 of connecting member 46 reaches a position aligned with side opening 106 of door 10, interconnecting wall 484 of draw rod 48 is fixed to first end 462 of connecting member 46 via side opening 106 (FIG. 8). First and second sidewalls 481 of draw rod 48 is extended through one of upper and lower slots 323 of base 32 and coupled to adjusting block 44 by extending a fastener 480 through each through-hole 486 of draw rod 48 into one of positioning holes 444 of adjusting block 44, assuring stable, joint movement of adjusting block 44 and draw rod 48 in the vertical direction. Thus, movement of adjusting blocks 44 in the vertical direction causes movement of connecting members 46 and connecting rods 16 in the vertical direction, moving latches 128 between the extended, locking positions and the retracted, unlocking positions. Note that sliding slots 325 allow vertical movement of first and second sidewalls 481 of draw rod 48.

Figure 2:
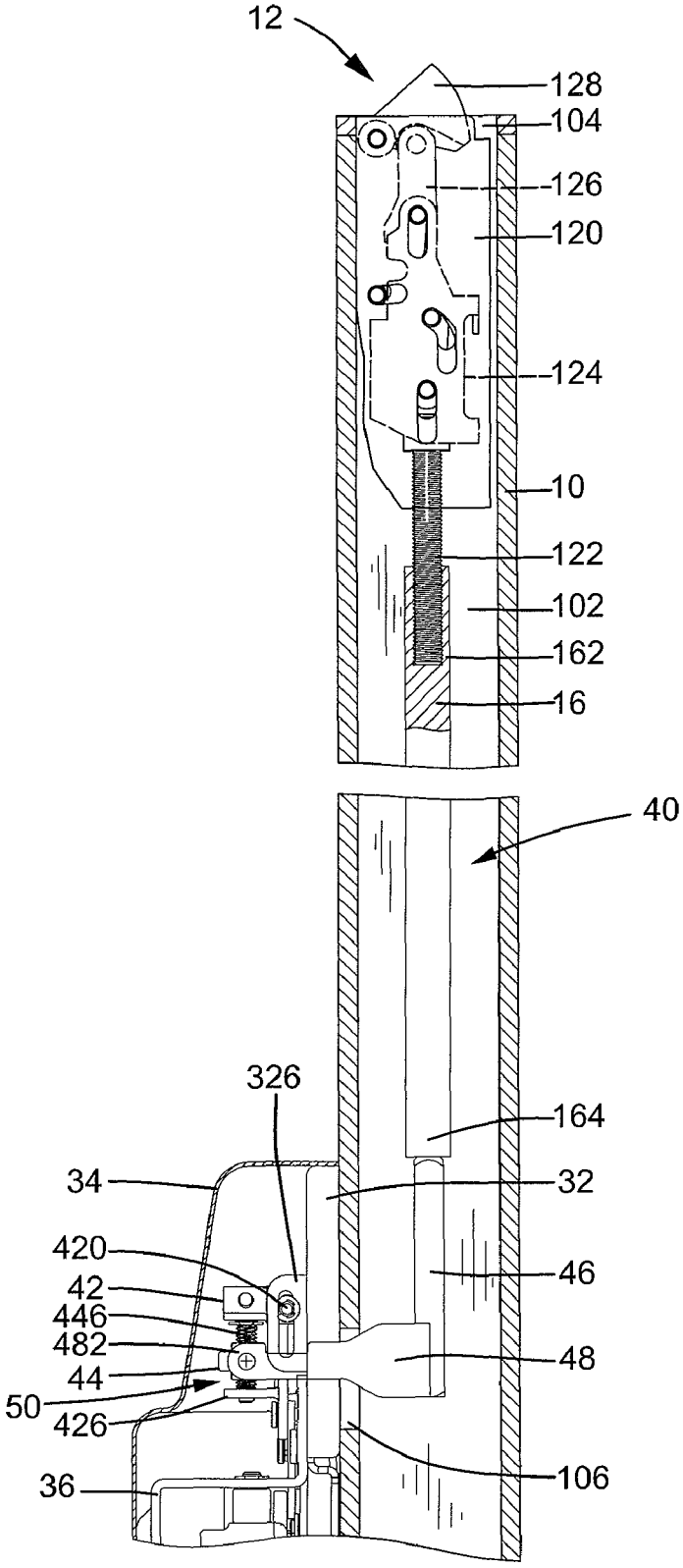
FIG. 2 shows a partial, cross-sectional view of the door and the lock of FIG. 1 according to section line 2-2 of FIG. 1.
Figure 3:
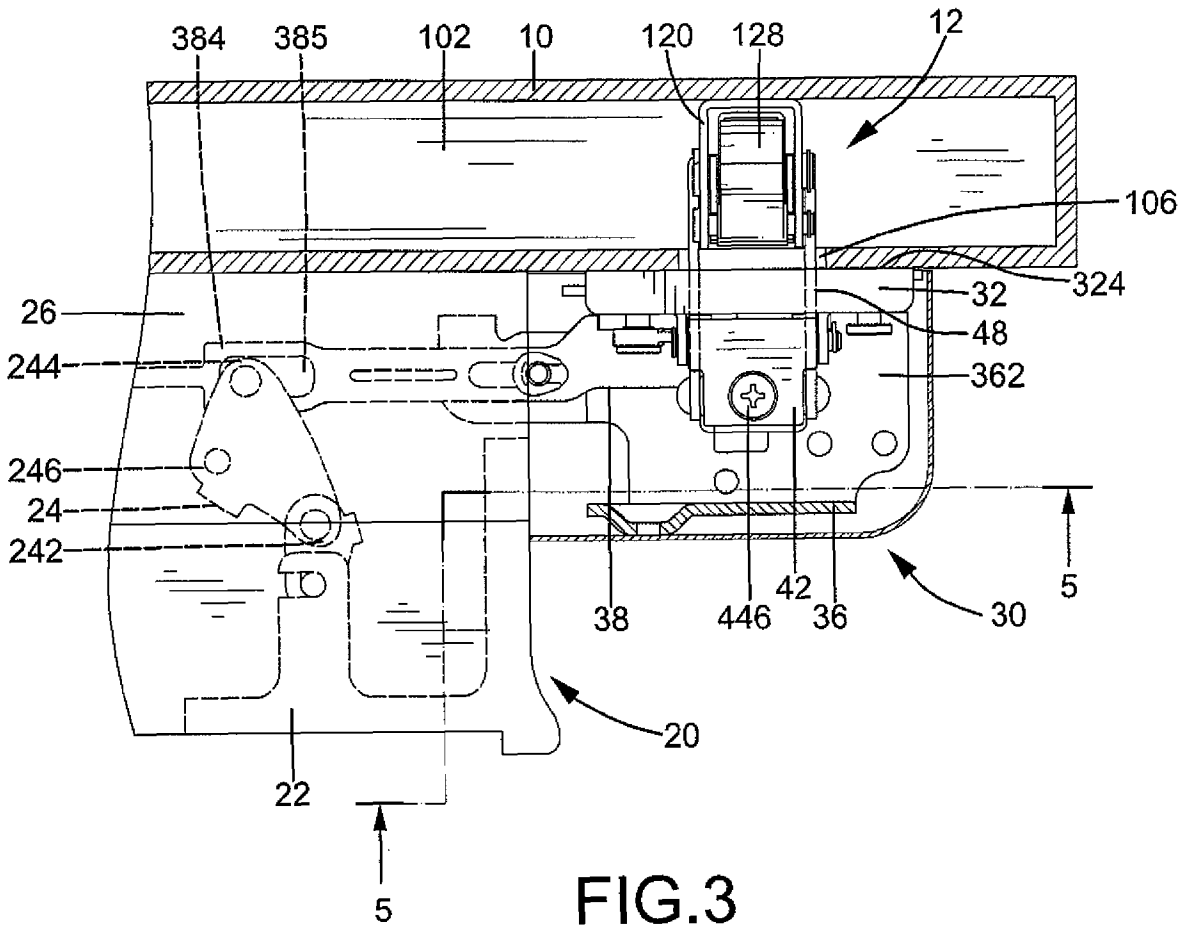
FIG. 3 shows a partial, cross-sectional view of the door and the lock of FIG. 1 according to section line 3-3 of FIG. 1.
Figure 4:
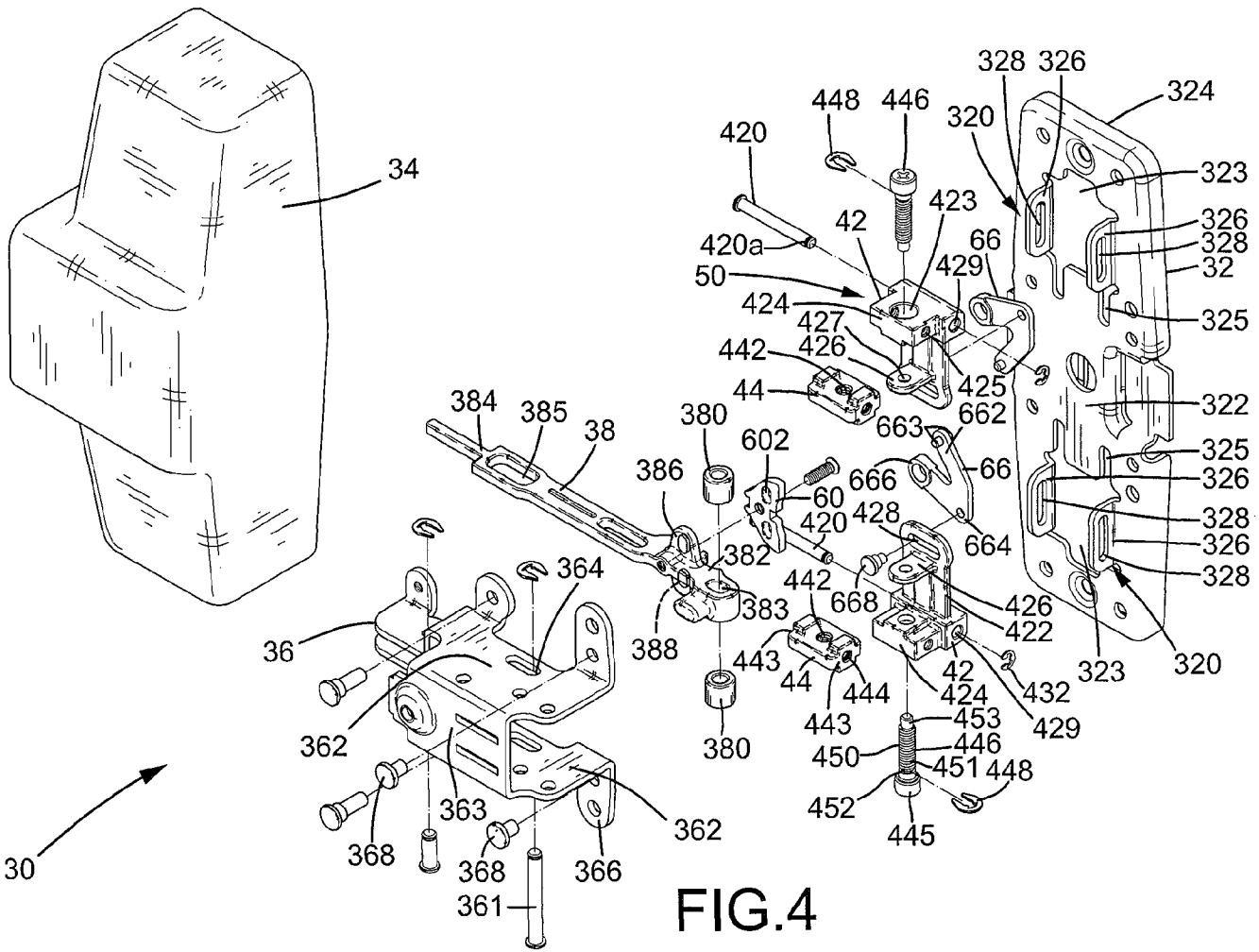
FIG. 4 shows a partial, exploded, perspective view of a follower device of the lock of FIG. 1.
Figure 5:
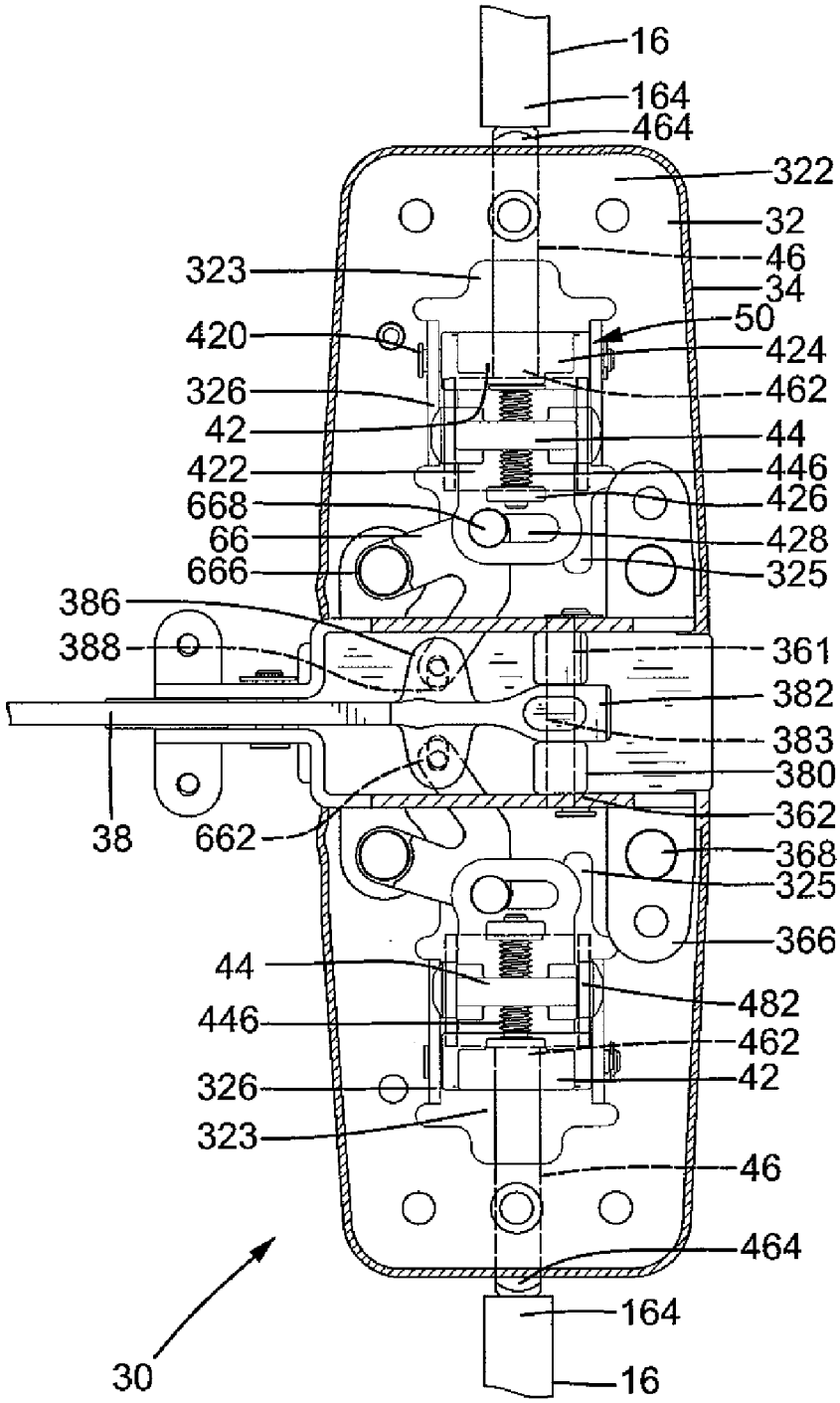
FIG. 5 shows a partial, cross-sectional view of the lock of FIG. 1 according to section line 5-5 of FIG. 3.
Figure 6:
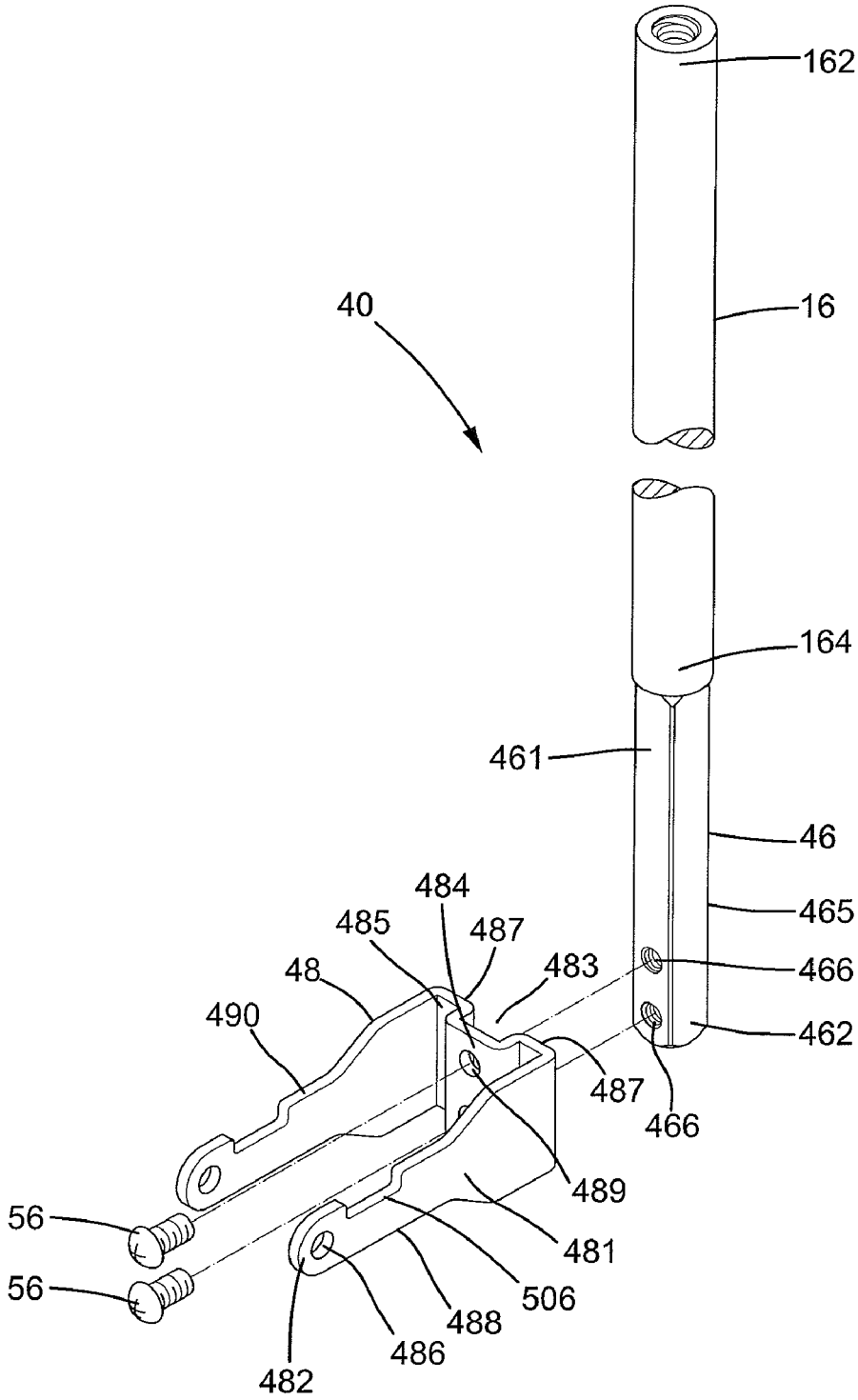
FIG. 6 shows an exploded, perspective view of a connecting device according to the preferred teachings of the present invention utilized in the lock of FIG. 1.
Figure 7:
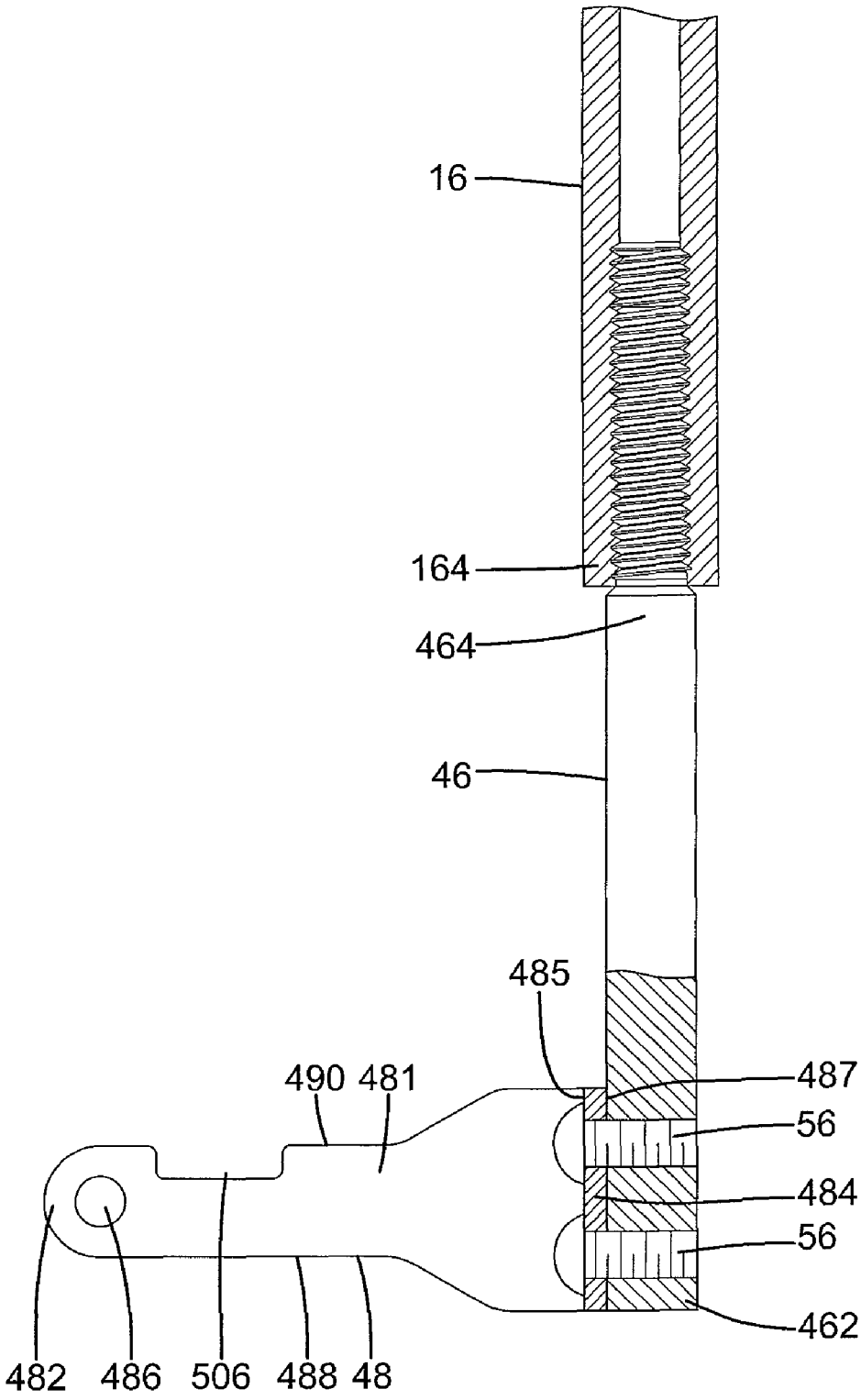
FIG. 7 shows a side view of the connecting device of FIG. 6.
Figure 11:
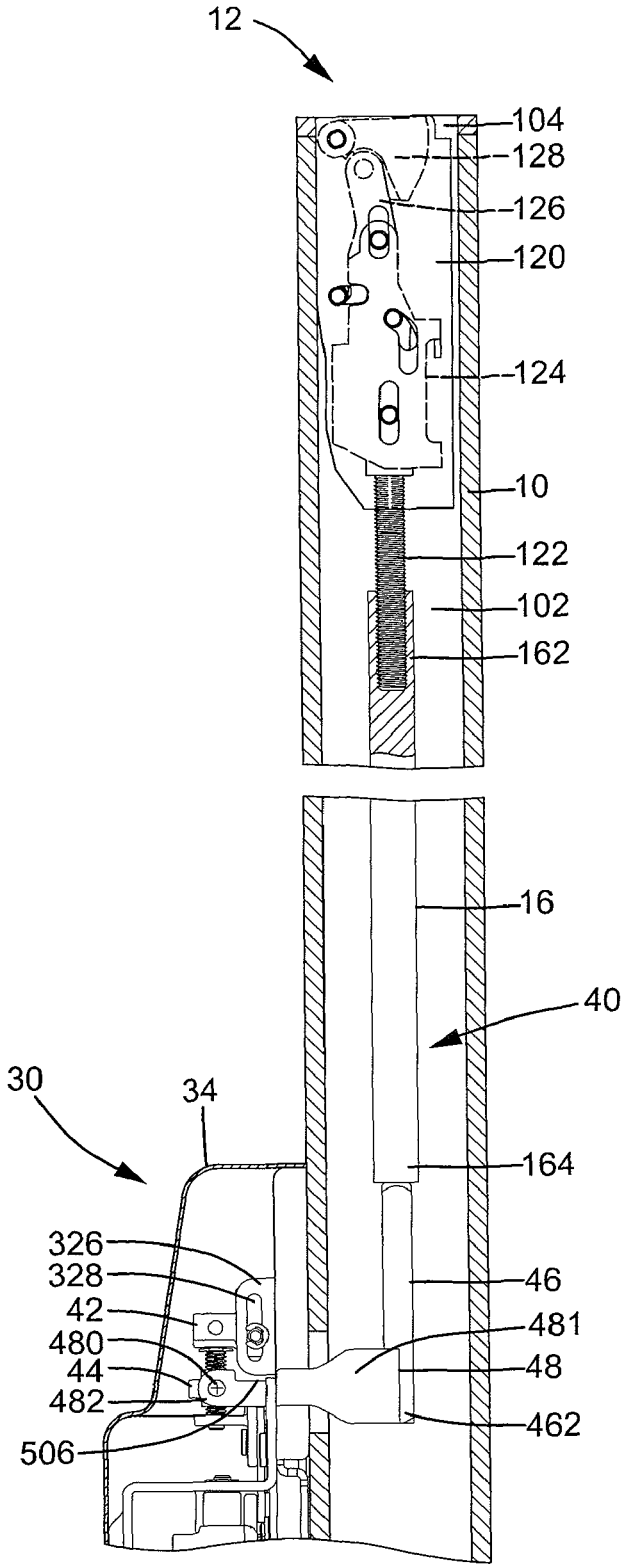
FIG. 11 shows a partial, cross-sectional view of the lock of FIG. 1 with the top latch moved to a retracted, unlocking position.
Figure 12:
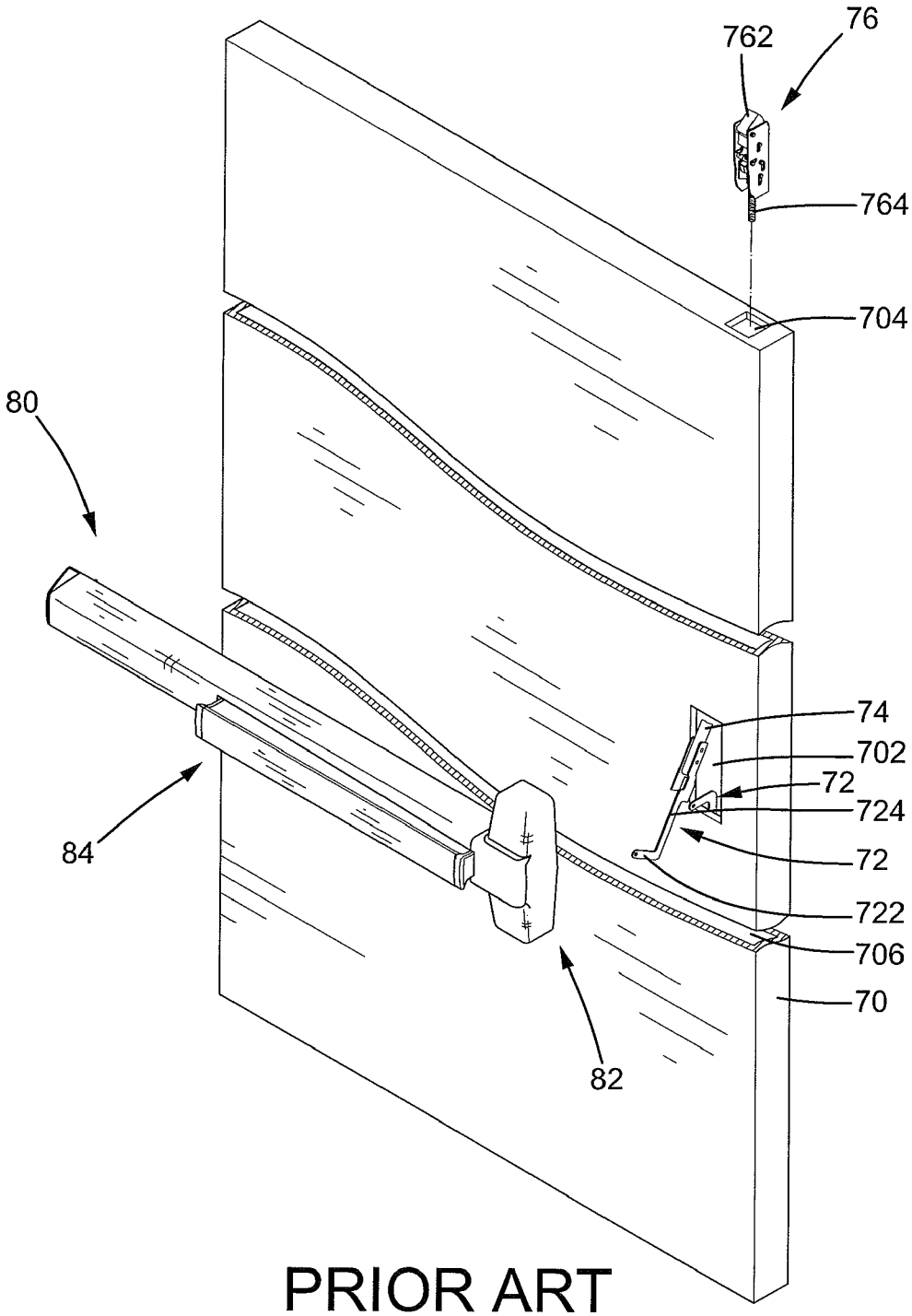
PRIOR ART FIG.12
FIG. 12 shows a perspective view of a panic exit door and a conventional lock, illustrating mounting of a connecting device and a latch of the lock to the panic exit door.

In operation, when linking rod 38 is moved in the unlatching direction such as due to pressing of operative member 22, links 66 are pivoted to move upper and lower slides 42 toward each other. Connecting devices 40 are moved toward each other to move connecting rod 16. Latches 128 are, thus, moved to the retracted, unlocking positions (FIG. 11). When operative member 22 is released, linking rod 38 is moved in a latching direction opposite to the unlatching direction to return latches 128 to the extended, locking positions (FIG. 2).

After installation of latch devices 12 onto door 10, the spacing from an end of each screw rod 122 to one of adjusting blocks 44 is fixed. After coupling with connecting rods 16, the projections of latches 128 are dependent upon the overall lengths of connecting devices 40 in the vertical direction. In a case that the overall length of each connecting device 40 is smaller than the spacing, the projection of latch 128 will be insufficient to provide the required locking functions. Although rotation of connecting rod 16 is impossible after connecting devices 40 are coupled with follower device 30, adjustment of the projections of latches 128 is still possible by sliding device 50. Specifically, adjusting screws 446 can be rotated to move adjusting blocks 44 in the vertical direction. This causes movement of connecting rods 16 in the vertical direction to change the projections of latches 128. Note that notches 506 allow movement of draw rod 48 to a position adjacent to slides 42 without interference to the adjustment operation. Thus, the lock according to the preferred teachings of the present invention allows easy adjustment of extended, locking positions of latches 128 relative to door 10 in an easier manner without the need of detaching components of the lock, saving time for installation.

Now that the basic teachings of the present invention have been explained, many extensions and variations will be obvious to one having ordinary skill in the art. For example, interconnecting wall 484 of draw rod 48 can be fixed to first end 462 of each connecting member 46 by male/female coupling. Furthermore, connecting member 46 can include only one coupling hole 466, and interconnecting wall 484 of draw rod 48 can include only one through-hole 489. Further, connecting device 40 according to the preferred teachings of the present invention can be utilized with top or bottom latch device 12 of any desired form as conventional including but not limited to of a commercially available type.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A lock for a door, with the door including a side, with the lock comprising:

a latch movable between an extended, locking position not allowing opening of the door and a retracted, unlocking position allowing opening of the door;

a connecting member including first and second ends spaced in a vertical direction, with the second end of the connecting member operably coupled to the latch;

a draw rod including first and second sidewalls spaced in a width direction perpendicular to the vertical direction, with the draw rod further including an interconnecting wall interconnected between the first and second sidewalls of the draw rod and securely mounted to the first end of the connecting member;

a base adapted to be fixed to the side of the door;

a slide slideably mounted to the base in the vertical direction;

an operative member operably connected to the slide; and an adjusting block mounted to the slide, with the adjusting block and the slide jointly moveable in the vertical direction, with the adjusting block including first and second sides spaced in the width direction, with the first and second sidewalls of the draw rod respectively fixed to the first and second sides of the adjusting block to move therewith, with the adjusting block moveable relative to the slide in the vertical direction to adjust the extended, locking position of the latch relative to the door, with manual operation of the operative member causing movement of the slide, the adjusting block, and the connecting member in the vertical direction to move the latch between the extended, locking position for locking the door and the retracted, unlocking position for unlocking the door.

2. The lock as claimed in claim 1, with the slide including a pivotal section, with the lock further comprising:

an adjusting screw rotatably extending through the pivotal section of the slide and threadedly coupled to the adjusting block to engage the adjusting block with the slide, with rotation of the adjusting screw causing movement of the adjusting block and the connecting member in the vertical direction to adjust the extended, locking position of the latch relative to the door.

3. The lock as claimed in claim 2, with the first end of the connecting member including first and second faces spaced in a thickness direction perpendicular to the vertical and width directions, with the first end of the connecting member having a first width in the width direction, with the interconnecting wall of the draw rod including first and second faces spaced in the thickness direction, with the interconnecting wall of the draw rod further including a recessed portion, with the recessed portion having a second width in the width direction approximately the same as the first width, with the first end of the connecting member received in the recessed portion with the first face of the first end of the connecting member abutting the second face of the interconnecting wall.

4. The lock as claimed in claim 3, with the adjusting block sandwiched between the first and second sidewalls of the draw rod in the width direction.

5. The lock as claimed in claim 4, with a coupling hole extending from the first face through the second face of the first end of the connecting member, with a through-hole extending from the first face through the second face of the interconnecting wall, and with a fastener extending through the through-hole of the interconnecting wall of the draw rod into the coupling hole of the first end of the connecting member.

6. The lock as claimed in claim 5, with each of the first and second sidewalls of the draw rod including a distal end distant to the interconnecting wall, with the adjusting block further including a positioning hole in each of the first and second sides, with the draw rod further including a through-hole in each of the distal ends of the first and second sidewalls, and with a fastener extending through each of the through-holes of the draw rod into one of the positioning holes of the adjusting block, fixing the distal ends of the first and second sidewalls of the draw rod to the first and second sides of the adjusting block.

7. The lock as claimed in claim 6, with each of the first and second sidewalls of the draw rod including outer and inner faces spaced in the vertical direction, and with each of the first and second sidewalls of the draw rod further including a notch in one of the outer and inner faces for avoiding interference when the draw rod is moved in the vertical direction by rotating the adjusting screw.

* * * * *